US010266957B2

(12) United States Patent
Sugawara et al.

(10) Patent No.: US 10,266,957 B2
(45) Date of Patent: Apr. 23, 2019

(54) CHROME-PLATED PART AND MANUFACTURING METHOD OF THE SAME

(75) Inventors: Soichiro Sugawara, Zama (JP); Hiroshi Sakai, Sagamihara (JP); Philip Hartmann, Berlin (DE)

(73) Assignees: NISSAN MOTOR CO., LTD., Yokohama-shi (JP); ATOTECH DEUTSCHLAND GMBH, Berlin (DE)

( * ) Notice: Subject to any disclaimer, the term of this patent is extended or adjusted under 35 U.S.C. 154(b) by 193 days.

(21) Appl. No.: 13/148,807

(22) PCT Filed: Feb. 13, 2009

(86) PCT No.: PCT/JP2009/000581
§ 371 (c)(1),
(2), (4) Date: Nov. 15, 2011

(87) PCT Pub. No.: WO2010/092622
PCT Pub. Date: Aug. 19, 2010

(65) Prior Publication Data

US 2012/0052319 A1 Mar. 1, 2012

(30) Foreign Application Priority Data

Feb. 13, 2009 (JP) ..... 2009-030706

(51) Int. Cl.
*C25D 5/14* (2006.01)
*C23C 28/00* (2006.01)
(Continued)

(52) U.S. Cl.
CPC ..... *C25D 5/14* (2013.01); *C23C 28/322* (2013.01); *C23C 28/3455* (2013.01); *C25D 3/06* (2013.01);
(Continued)

(58) Field of Classification Search
None
See application file for complete search history.

(56) References Cited

U.S. PATENT DOCUMENTS 2,871,550 A 2/1959 Weinberg et al.
3,157,585 A * 11/1964 Durham ..... 205/179
(Continued)

FOREIGN PATENT DOCUMENTS

CA 1021712 11/1977
EP 1 343 924 B1 10/2006
(Continued)

OTHER PUBLICATIONS

Mark Schario, "Troubleshooting decorative nickel plating solutions (Part II of III Installments)", Metalfinishing, May 2007, pp. 41-44, XP002554282.
(Continued)

*Primary Examiner* — Adam Krupicka
(74) *Attorney, Agent, or Firm* — Foley & Lardner LLP

(57) ABSTRACT

The present invention is to provide a chrome-plated part having a corrosion resistance in normal and specific circumstances and not requiring additional treatments after chrome plating, and to provide a manufacturing method of such a chrome plated part. The chrome-plated part 1 includes: a substrate 2; a bright nickel plating layer 5*b* formed over the substrate 2; a noble potential nickel plating layer 5*a* formed on the bright nickel plating layer 5*b*. An electric potential difference between the bright nickel plating layer 5*b* and the noble potential nickel plating layer 5*a* is within a range from 40 mV to 150 mV. The chrome-plated part 1 further includes: a trivalent chrome plating layer 6 formed on the noble potential nickel plating layer 5*a* and having at least any one of a microporous structure and a microcrack structure.

21 Claims, 5 Drawing Sheets

(51) Int. Cl.
*C25D 3/06* (2006.01)
*C25D 3/12* (2006.01)

(52) U.S. Cl.
CPC ..... *C25D 3/12* (2013.01); *Y10T 428/12479* (2015.01)

(56) References Cited

U.S. PATENT DOCUMENTS

| | | | | | |
|---|---|---|---|---|---|
| 3,183,067 | A | | 5/1965 | Du Rose et al. | |
| 3,288,574 | A | * | 11/1966 | Du Rose et al. | 428/639 |
| 3,355,267 | A | | 11/1967 | Du Rose | |
| 3,625,039 | A | * | 12/1971 | Kubach et al. | C21D 7/06 205/180 |
| 3,866,289 | A | | 2/1975 | Brown et al. | |
| 3,917,517 | A | * | 11/1975 | Jordan et al. | 205/243 |
| 3,954,574 | A | | 5/1976 | Gyllenspetz | |
| 3,994,694 | A | | 11/1976 | Clauss et al. | |
| 4,007,099 | A | * | 2/1977 | Wu | C25D 5/48 205/178 |
| 4,159,230 | A | * | 6/1979 | Barnes et al. | 428/613 |
| 5,672,262 | A | * | 9/1997 | Johnson et al. | 205/255 |
| 2008/0274373 | A1 | | 11/2008 | Takahashi | |

FOREIGN PATENT DOCUMENTS

| | | | |
|---|---|---|---|
| EP | 1 845 176 | A1 | 10/2007 |
| GB | 1 402 209 | A | 8/1975 |
| JP | S4840542 | B | 12/1973 |
| JP | S54-37564 | | 11/1979 |
| JP | 05-171468 | A | 7/1993 |
| JP | 05-287579 | A | 11/1993 |
| JP | 06-146069 | A | 5/1994 |
| JP | 8-100273 | A | 4/1996 |
| JP | 10-25594 | A | 1/1998 |
| JP | 2005-232529 | A | 9/2005 |
| JP | 2006-70894 | A | 3/2006 |
| JP | 2007-056282 | A | 3/2007 |
| JP | 2007-275750 | A | 10/2007 |
| JP | 2008-31555 | A | 2/2008 |
| JP | 2008-050656 | A | 3/2008 |
| JP | 2009-074170 | A | 4/2009 |
| RU | 2139369 | C1 | 10/1999 |
| SU | 359973 | A | 9/1977 |
| SU | 882417 | A3 | 11/1981 |
| WO | WO 2006/043507 | A1 | 4/2006 |
| WO | WO 2009/028182 | A2 | 3/2009 |

OTHER PUBLICATIONS

Wuhan Hechang Chemicals Co., Ltd: "(TCA) Chloral hydrate (CAS No: 302-17-0)", Internet Citation, [Online], Sep. 9, 2008 (Sep. 9, 2008), XP002554430, Retrieved from the Internet: URL:http://www.tradekey.com/product_view/id/696242.htm> [retrieved on Nov. 9, 2009].

Kazuo Watanabe, "Decorative Trivalent Chromium Plating" (with English Translation), pp. 20-24, Dec. 21, 2005.

Mike Barnsted, et al., Trivalent Chromium for a New Generation, Metal Finishing, vol. 107 No. 1, pp. 27-30, 33, 2009. 1.

"Chrome-Plated Plastic Parts," Volkswagen AG Group Standard, Jun. 2008, TL528.

"Minimum Performance Requirements for Decorative Chromium Plated Plastic Parts," General Motors Worldwide Engineering Standards, Feb. 2007, GMW14668.

Baosong Li et al., "Preparation and characterization of Cr-P coatings by electrodeposition from trivalent chromium electrolytes using malonic acid as complex," Surface & Coatings Technology, Dec. 4, 2006, pp. 2578-2586, vol. 201, Issue 6.

G. A. Dibari et al, "The Corrosion Performance of Decorative Electrodeposited Nickel Chromium Coating", Surface Technology, Feb. 1990, vol. 41, No. 2, pp. 91-98.

Gunther A. Lausmann, "Chromium Plating," Series of electroplating and surface treatment 1st edition, Dec. 22, 2006, pp. 144-157.

Kamitani Masaaki, "High corrosion resistance micro porous chrome plating," Monthly Meeting of Plating Technology Subcommittee, Nov. 19, 1993, pp. 20-27.

Robert A. Tremmel, "Methods to Improve the Corrosion Performance of Microporous Nickel Deposits," Plating and Surface Finishing, Oct. 1996, pp. 24-28.

Soichiro Sugawara et al., "Mechanism study of specific corrosion by de-icing salt and its prevention method for decorative chrome plating", Transactions of Society of Automotive Engineering of Japan, May 2009, pp. 1303-1308, vol. 40, No. 5.

Guidebook for Plating Technology, Tokyo Plating Material Cooperative Association, Dec. 16, 1987, pp. 156-171.

* cited by examiner (a)

(b)

CHROME-PLATED PART AND MANUFACTURING METHOD OF THE SAME

TECHNICAL FIELD

The present invention relates to a chrome-plated part represented by a decorative part such as an emblem or a front grille of an automobile, and relates to a method of manufacturing the same. More specifically, the present invention relates to a chrome-plated part having high corrosion resistance and blisters caused by various types of damage by salt attack, and providing a white silver design similar or equivalent to hexavalent chrome plating.

BACKGROUND ART

Automobile exterior parts such as emblems, front grilles (radiator grilles), and door handles of automobiles are subjected to chrome plating. The chrome plating improves aesthetic appearance, increases surface hardness to prevent scratches, and furthermore provides corrosion resistance to avoid rust.

Conventionally, plated parts sequentially coated with a substantially non-sulfur semi-bright nickel plating layer, a bright nickel plating layer, an eutectoid nickel plating layer (a distributed strike nickel plating layer), and a chrome plating film on a substrate have been disclosed as chrome-plated parts (see Patent Citations 1 to 3). In these conventional arts, it has been disclosed that an electrochemical potential of the nickel plating layer is controlled within a predetermined range so as to prevent detachment of the chrome plating layer.

Patent Citation 1: Japanese Patent Unexamined Publication No. H05-287579

Patent Citation 2: Japanese Patent Unexamined Publication No. H06-146069

Patent Citation 3: Japanese Patent Unexamined Publication No. H05-171468

Recently, corrosion cases in a specific circumstance have been recognized. Specifically, one case is that a chrome plating layer as a surface is corroded prior to a nickel plating layer as a base, which causes aesthetic appearance to get worse, and another case is that gas, which makes plated parts swollen, is generated by severe corrosion of a nickel plating layer as a base. Such cases have highly occurred to decorative chrome-plated parts of various types of automobiles, especially, such as front grilles, emblems and door handles. A snow-melting agent used for avoiding roads being frozen and hygroscopic salt (such as calcium chloride, magnesium chloride and sodium chloride) used for avoiding road dust being dispersed adhere to these parts with an adsorptive material such as mud. The concentration of salt (chloride ion) on the parts to which the snow-melting agent is adhered increases due to water evaporation.

In such a case of being covered with chloride ion at high concentration, and under environmental condition with hot and cold cycle of a heated motor garage and an outdoor location of which temperature drops to below freezing, the severe corrosion has been caused.

For purpose of enhancing the corrosion resistance in such a specific circumstance, a method for forming a passive film on the chrome plating layer using an oxidizing agent is disclosed (see Patent Citations 4 to 7).

Patent Citation 4: Japanese Patent Unexamined Publication No. 2005-232529

Patent Citation 5: Japanese Patent Unexamined Publication No. 2007-056282

Patent Citation 6: Japanese Patent Unexamined Publication No. 2007-275750

Patent Citation 7: Japanese Patent Unexamined Publication No. 2008-050656

DISCLOSURE OF INVENTION

According to Patent Citations 1 to 3, these prior arts have the corrosion resistance in the normal environment, however cannot be tolerant of the corrosion in the specific circumstance. As a result, it causes exfoliation and blisters of the plating. In addition, it is obvious that Examples described in these Patent Citations are evaluated limiting to hexavalent chrome plating in practice according to the plating methods described therein. Further, it is described in Patent Citation 3 that blisters of the plating are easily caused when an electric potential difference between the bright nickel plating layer and the eutectoid nickel plating layer is 60 mV or more. Since small blisters are detected even at 60 mV according to the Examples, it can be read that the optimum range of the electric potential difference between the bright nickel plating layer and the eutectoid nickel plating layer is from 20 to 40 mV. Moreover, the evaluation when the electric potential difference between the bright nickel plating layer and the eutectoid nickel plating layer is 60 mV or more has not been performed in Patent Citations 1 and 2.

Moreover, according to Patent Citations 4 to 7, additional treatments are required after the chrome plating, which results in the increase in cost. Further, regarding the corrosion resistance in the specific circumstance, the prior arts do not have enough tolerance for the corrosion so as to be tolerant of the harsh environment of usage.

The present invention has been made focusing on the above-mentioned conventional problems. An object of the present invention is to provide a chrome-plated part having a corrosion resistance in normal and specific circumstance and not requiring additional treatments after chrome plating, and to provide a manufacturing method of the chrome-plated part.

The first aspect of the present invention provides a chrome-plated part including: a substrate; a bright nickel plating layer formed over the substrate; a noble potential nickel plating layer formed on the bright nickel plating layer, wherein an electric potential difference between the bright nickel plating layer and the noble potential nickel plating layer is within a range from 40 mV to 150 mV; and a trivalent chrome plating layer formed on the noble potential nickel plating layer and having at least any one of a microporous structure and a microcrack structure.

The second aspect of the present invention provides a method of manufacturing a chrome-plated part including: forming a bright nickel plating layer over the substrate; forming a noble potential nickel plating layer on the bright nickel plating layer, wherein an electric potential difference between the bright nickel plating layer and the noble potential nickel plating layer is within a range from 40 mV to 150 mV; and forming a trivalent chrome plating layer on the noble potential nickel plating layer.

BRIEF DESCRIPTION OF THE DRAWINGS

FIG. 4(*b*) is a picture showing a test piece of Example 4 after the corrosion test 1 for 80 hours.

FIG. 5(*b*) is a picture showing a test piece of Example 1 before the corrosion test 2.

FIG. 7(*b*) is a cross-sectional picture of the test piece of FIG. 7(*a*).

BEST MODE FOR CARRYING OUT THE INVENTION

Figure 1:
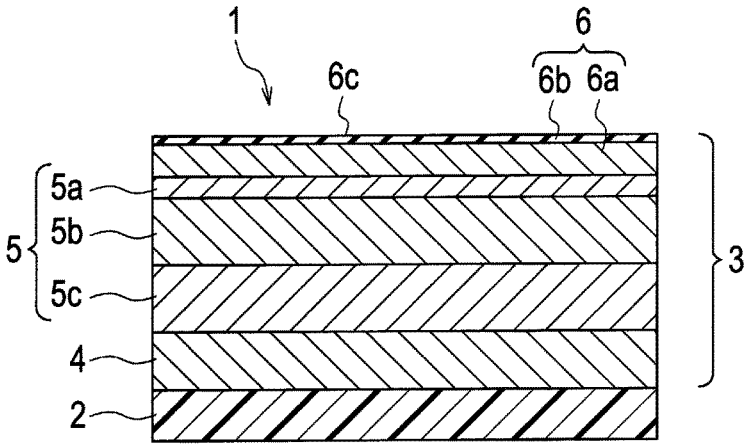
FIG. 1 is a schematic view showing a chrome-plated part according to an embodiment of the present invention.

A description will be made below in detail of an embodiment of the present invention with reference to the figures. Note that, in the figures described below, materials having identical functions are indicated with the same reference numerals, and the repetitive explanations are omitted.

FIG. 1 shows a chrome-plated part according to the embodiment of the present invention. Regarding the chrome-plated part 1, a copper plating layer 4 for surface preparation is formed over a substrate 2, then a non-sulfur nickel plating layer 5*c*, a bright nickel plating layer 5*b* and a noble potential nickel plating layer 5*a* are sequentially formed on the copper plating layer 4, followed by chromium-plating so as to form a chrome plating layer 6.

By means of such a multiple plating structure, it is possible to maintain the aesthetic appearance of the chrome plating layer 6 of the outer layer. Specifically, with regard to the relationship between the chrome plating layer 6 as the outer layer and the nickel plating layer 5 as the substrate layer of the chrome plating layer 6, an electric potential of the nickel plating layer 5 is set at a range that the nickel plating layer 5 is easier to be electrochemically corroded than the chrome plating layer 6. It means that the potential of the nickel plating layer 5 is set at a base potential with respect to the chrome plating layer 6. Thus, the nickel plating layer 5 is corroded instead of the chrome plating layer 6 so as to maintain the aesthetic appearance of the chrome plating layer 6 of the outer layer.

According to the comparison in the standard electrode potential in the electrochemical field, chromium fundamentally has a property of the base potential compared to nickel, and is easier to be corroded than nickel. However, under the normal use condition, the chrome plating layer itself produces a several nm-thick and rigid passive film on its surface due to its own passivation ability that chromium has. The chrome plating layer is present as a compound film combined with a chrome plating film and a passive film. Thus, the chrome plating layer can be a noble potential layer compared to the nickel plating layer. Therefore, the nickel plating layer is corroded instead of the chrome plating layer so as to be able to maintain the aesthetic appearance of the chrome plating layer of the surface.

An explanation is provided as follow regarding the multiple layer structure of the nickel plating layer 5. The nickel plating layer 5 has a multiple layer structure composed of a non-sulfur nickel plating layer 5*c*, a bright nickel plating layer 5*b* and a noble potential nickel plating layer 5*a*. With respect to the intention to have such a multiple layer structure, the noble potential nickel plating layer, such as microporous nickel plating and microcrack nickel plating, provides fine pores (microporous) or fine cracks (microcracks) to the chrome plating layer 6. Due to dispersion of corrosion current by a plurality of the fine pores or cracks, the local corrosion of the bright nickel plating layer 5*b* of a lower layer is controlled. Thus, the corrosion resistance of the nickel plating layer 5 itself is enhanced, and it is possible that the aesthetic appearance of the chrome plating layer 6 of the outer surface can be maintained for a long period.

The chrome-plated part 1 of the present embodiment includes the substrate 2, the bright nickel plating layer 5*b* formed over the substrate 2, the noble potential nickel plating layer 5*a* formed on and being contact with the bright nickel plating layer 5*b* and having 40 mV to 150 mV of the electric potential difference between the bright nickel plating layer 5*b*, and the trivalent chrome plating layer 6 formed on and being contact with the noble potential nickel plating layer 5*a*. The bright nickel plating layer 5*b*, the noble potential nickel plating layer 5*a* and the trivalent chrome plating layer 6 are formed over the substrate 2, and included in an all plating layer 3 composed of a plurality of metallic plating layers.

Due to set the electric potential difference between the bright nickel plating layer 5*b* and the noble potential nickel plating layer 5*a* at 40 mV to 150 mV, the electric potential of the bright nickel plating layer 5*b* becomes the base potential with respect to the noble potential nickel plating layer 5*a*. It enables the effect of the sacrificial corrosion of the bright nickel plating layer 5*b* to be increased, and the corrosion resistance not only in the normal circumstance but also in the specific circumstance to be improved. If the electric potential difference is below 40 mV, the effect of the sacrificial corrosion of the bright nickel plating layer 5*b* becomes lower. Further, it may result in not being able to keep the high corrosion resistance in the normal circumstance unless a certain aftertreatment is performed after the chrome plating.

The present embodiment is characterized by setting the electric potential difference between the bright nickel plating layer 5*b* and the noble potential nickel plating layer 5*a* at 40 mV to 150 mV. However, simply setting the electric potential difference between these layers at 40 mV or more still causes blisters as described in the conventional art. Particularly, it is described in the above-mentioned Patent Citations that blisters of the plating are easily caused when an electric potential difference is 60 mV or more. Therefore, in addition to the electric potential difference, the present embodiment is characterized by using the trivalent chrome plating layer, as the chrome plating layer 6, provided by reducing chromium of which a valence is trivalent. The trivalent chrome plating layer has at least one of the microporous structure and the microcrack structure. This enables the corrosion to be dispersed into the whole nickel plating layer 5 without making the corrosion concentrated in a specific area of the nickel plating layer 5. Thus, it does not cause the locally concentrated corrosion as causing blisters and the corrosion accompanying blisters even if the electric potential difference is 40 mV or more, especially 60 mV or more. By setting the electric potential difference at 40 mV to 150 mV, it is possible to fulfill the higher resistance to the corrosion and blisters caused by various types of damage by salt attack. Further, by setting the electric potential difference at 60 mV to 120 mV, it is possible to fulfill the greater resistance to the corrosion and blisters. Note that, however, the electric potential difference may be over 150 mV as long as it does not adversely affect the properties of the nickel plating layer 5 and the chrome plating layer 6.

Preferably, the trivalent chrome plating layer 6 includes more than 10000/cm$^2$ of fine pores on its surface 6*c*, and more preferably, more than 50000/cm$^2$ of fine pores on its surface 6*c*. As described above, there is a defect in the conventional art that it easily causes blisters by setting the electric potential difference at 60 mV or more. In the present embodiment, however, it is possible to overcome the problem in the conventional art by making effective use of the quite fine and numerous pores in the microporous structure and microcrack structure that the trivalent chrome plating layer 6 itself has.

Moreover, the trivalent chrome plating layer 6 is preferably an amorphous material not in crystal condition. By being amorphous, it is possible to highly reduce the plating defect that may cause the starting point of occurrence of the corrosion. Note that, it is possible to evaluate whether it is amorphous or not by determining crystalline peaks of chromium by use of an X-ray diffractometer (XRD) as described below.

The film thickness of the trivalent chrome plating layer 6 is preferably between 0.05 to 2.5 micrometers, and more preferably, between 0.15 to 0.5 micrometers. Even if the film thickness of the trivalent chrome plating layer 6 is not within the range of 0.05 to 2.5 micrometers, it is possible to obtain the effects of the present invention. However, if the thickness is less than 0.05 micrometers, it may be difficult to keep the design of the aesthetic appearance and the plating resistance. While, if the thickness is more than 2.5 micrometers, it may cause cracks by stress and result in decreasing the corrosion resistance. Note that, it is preferable to use a so-called wet plating method to form the trivalent chrome plating layer 6. However, it may be used a method such as a vapor deposition plating method.

As described above, the chrome plating layer 6 itself produces 5 nm or below of a rigid passive film 6*b* of on its surface due to its own passivation ability that chromium has. Therefore, as shown in FIG. 1, a chrome plating film 6*a* formed of metal chromium produced by reducing trivalent chromium ($Cr^{3+}$) is mainly present as an inner layer of the trivalent chrome plating layer 6, and a passive film 6*b* formed of chromium oxide is present on the surface of the chrome plating film 6*a*. In the present embodiment, it is preferable that the chrome plating layer 6 includes carbon (C) and oxygen (O). Moreover, it is preferable that the trivalent chrome plating layer 6 includes 10 to 20 at % (atomic percent) of carbon. By mixing a metalloid element having an intermediate property between metal and non-metal such as carbon (C), oxygen (O) and nitrogen (N) into the chrome plating layer 6, and forming a eutectoid with the metalloid element and chromium, it makes an amorphous level of the chrome plating layer 6 increased. Thus, it is possible to highly reduce the plating defect that may cause the starting point of occurrence of the corrosion. Furthermore, by adding the metalloid element to the chrome plating layer 6, it makes the chrome plating layer 6 a noble potential, and therefore, it enables the corrosion resistance to calcium chloride to be enhanced. The metalloid element for the eutectoid in the chrome plating layer 6 is not limited to carbon, and it is possible to obtain the similar effects by the eutectoid of the other metalloid elements. In the present embodiment, the corrosion resistance improves in the case of the ratio that carbon and oxygen are approximately the same amount and in the case of the increased concentration of carbon and oxygen, respectively.

In addition, it is preferable that the trivalent chrome plating layer 6 includes at least one of 0.5 at % or more of iron (Fe) and 4.0 at % or more of carbon (C). Further, it is more preferable that the trivalent chrome plating layer 6 includes at least one of 1 to 20 at % of iron and 10 to 20 at % of carbon. Iron (Fe) has the effect of stabilizing the throwing power of the plating during the chrome plating bath. Moreover, iron (Fe) has the effect of enhancing capacity to densify the passive film 6*b* (oxide film) formed on the surface of the chrome plating layer 6. With regard to the contents of carbon, oxygen, iron and the like in the chrome plating layer 6, it is possible to obtain the contents by elemental analysis per 5 nm or 10 nm if the analysis is performed toward the depth direction from the surface of the chrome plating layer 6 by use of an X-ray photoelectron spectroscopy analysis (XPS).

The passive film 6*b* of the trivalent chrome plating layer 6 is a self-produced chromium oxide film due to its own passivation ability that chromium has. Thus, the film is formed without requiring special processes, in contrast with a chromium oxide film formed through an additional process using an oxidizing agent and the like as described in Patent Citations 4 to 7.

Next, the following is an explanation of a manufacturing method of the chrome-plated part of the present embodiment. A method of manufacturing the chrome-plated part includes the steps of: forming the bright nickel plating layer over the substrate; forming the noble potential nickel plating layer on the bright nickel plating layer with 40 mV to 150 mV of the electric potential difference therebetween; and forming the trivalent chrome plating layer on the noble potential nickel plating layer. The bright nickel plating layer, the noble potential nickel plating layer and the trivalent chrome plating layer are preferably manufactured by the step of the continuous treatments during the wet plating bath except for water rinsing steps between each step. If not performed by the continuous treatments, especially, if there are improper intervals between each step or once the surface is dried, it easily causes uneven coating or tarnish in the subsequent plating processes, and may result in disfigurement, and deterioration of the corrosion resistance.

The following is the method for setting the electric potential difference between the bright nickel plating layer 5*b* and the noble potential nickel plating layer 5*a* at 40 mV or more. The bright nickel plating layer 5*b* is the plating layer having a smooth and bright surface, and added a first brightening agent and a second brightening agent in the plating bath in order to bring out luster. In addition, it is preferable that the noble potential nickel plating layer 5*a* includes fine particles in dispersed condition as described later in order to make the structure having numerous microporous and microcracks on the chrome plating layer 6. In this case, the first brightening agent, the second brightening agent and the fine particles are added in the plating bath. To achieve the above-mentioned electric potential difference, an electric potential adjuster is added in the plating bath to form the noble potential nickel plating layer 5*a*. The part including the bright nickel plating layer 5*b* is electroplated in the plating bath containing the electric potential adjuster, thereby being able to obtain the noble potential nickel plating layer 5*a* having the above-mentioned electric potential difference.

The first brightening agent is an auxiliary agent added in order to solve difficulties, such as getting brittle and becoming sensitive to impurities, caused when the second brightening agent is used alone. The first brightening agent is available in a variety of types, as represented by 1,5-sodium naphthalene disulfonate, 1,3,6-sodium naphthalene trisulfonate, saccharin, paratoluene sulfonamide and the like. In addition, the second brightening agent gives a luster to the plating layer and, in many cases, possesses a smoothing effect. Also, the second brightening agent is available in a variety of types, as represented by formaldehyde, 1,4-butynediol, propargyl alcohol, ethylene cyanohydrin, coumarin, thiourea, sodium allylsulfonate and the like. In addition, the electric potential adjuster is available in a variety of types, as represented by butynediol, hexynediol, propargyl alcohol, sodium allylsulfonate, formalin, chloral hydrate (2,2,2-trichloro-1,1-ethanediol) and the like.

It is preferable that the trivalent chrome plating layer is produced by electroplating in the plating bath containing basic chromium sulfate ($Cr(OH)SO_4$) as a main component which is a metal supply source. In this case, it is preferable that the concentration of basic sulfate chromium is within a range from 90 to 160 g/l. Moreover, it is preferable that the plating bath contains, as additives, at least one of thiocyanate, monocarboxylate and dicarboxylate; at least one of ammonium salt, alkaline metal salt and alkaline earth metal salt; and a boron compound and a bromide, respectively.

The additive represented by thiocyanate, monocarboxylate and dicarboxylate functions as a bath stabilizing complexing agent allowing the plating to be stably continued. The additive represented by ammonium salt, alkaline metal salt and alkaline earth metal salt functions as an electrically conducting salt allowing electricity to flow through the plating bath more easily so as to increase plating efficiency. Furthermore, the boron compound as the additive functions as a pH buffer controlling pH fluctuations in the plating bath. The bromide has a function of suppressing generation of chlorine gas and production of hexavalent chromium on the anode.

More preferably, the trivalent chrome plating layer is produced by electroplating in the plating bath containing, as additives, at least one of ammonium formate and potassium formate as the monocarboxylate; at least one of ammonium bromide and potassium bromide as the bromide; and boric acid as the boron compound. Specifically, the trivalent chrome plating layer is preferably produced by electroplating, for Example, under the conditions that the plating bath contains: 130 g/l of basic chromium sulfate; and about 40 g/l of ammonium formate or about 55 g/l of potassium formate, and that the current density of electroplating is about 10 $A/dm^2$. In this case, the trivalent chrome plating layer with a thickness of 0.15 to 0.5 micrometers is produced.

Additionally, on the trivalent chrome plating layer, an aftertreatment is frequently performed, such as an immersion treatment for each solution and gas atmosphere, and electrolytic chromate, for the purpose of improvement of the resistance to the corrosion and dirt. As mentioned above, the present embodiment has sufficient corrosion resistance even without the aftertreatment after the chrome plating. However, it is possible to further enhance the resistance to the corrosion and dirt due to the aftertreatment.

A description will be made in detail of the chrome-plated part 1 in FIG. 1. In the chrome-plated part 1, a layer providing electrical conductivity to the surface of the substrate 2 is formed. Then, a copper plating layer 4 is formed as a base for the purpose of improvement of surface smoothness and the like. The nickel plating layer 5 is formed on the copper plating layer 4, and the trivalent chrome plating layer 6 is further formed on the nickel plating layer 5. Thus, the all plating layer 3 is formed with a multi-layer structure composed of the copper plating layer 4, the nickel plating layer 5 and the trivalent chrome plating layer 6. Due to the all plating layer 3 covering the substrate 2, the design utilizing a white silver color of the trivalent chrome plating layer 6 is provided. Note that, the thickness of the all plating layer 3 is generally about 5 micrometers to 100 micrometers.

Since the nickel plating layer 5 is easier to be electrochemically corroded compared with the chrome plating layer 6, the nickel plating layer 5 also has the multi-layer structure for improving the corrosion resistance. That is, the nickel plating layer 5 functions as a base of the trivalent chrome plating layer 6, and has a three-layer structure composed of the non-sulfur nickel plating layer 5*c*, the bright nickel plating layer 5*b* formed on the non-sulfur nickel plating layer 5*c*, and the noble potential nickel plating layer 5*a* formed on the bright nickel plating layer 5*b*. A corrodedispersing auxiliary agent is frequently added to the noble potential nickel plating layer 5*a*. The bright nickel plating layer 5*b* contains a sulfur content as a brightening agent. The sulfur content in the non-sulfur nickel plating layer 5*c* is much lower than that in the bright nickel plating layer 5*b*. By such a three-layer structure, the corrosion resistance of the nickel plating layer 5 is improved.

The improvement of the corrosion resistance of the nickel plating layer 5 is provided by a noble potential shift of the non-sulfur nickel plating layer 5*c* when compared to the bright nickel plating layer 5*b*. Because of the electric potential difference between the bright nickel plating layer 5*b* and the non-sulfur nickel plating layer 5*c*, the corrosion in the lateral direction of the bright nickel plating layer 5*b* is accelerated so that the corrosion toward the non-sulfur nickel plating layer 5*c*, i.e. in the depth direction is suppressed. Therefore, the corrosion is controlled toward the non-sulfur nickel plating layer 5*c* and copper plating layer 4 so as to take a longer time until disfigurement such as detachment of the plating layer 3 appears. In addition, in order to prevent the local corrosion of the bright nickel plating layer 5*b* as a base, the trivalent chrome plating layer 6 has numerous fine pores or cracks on its surface. Since the corrosion current is dispersed due to the fine pores or cracks, the local corrosion of the bright nickel plating layer 5*b* is suppressed and the corrosion resistance of the nickel plating layer 5 is improved. The fine pores and cracks formed on the trivalent chrome plating layer 6 is formed by adding fine particles and a stress adjuster in the plating bath when electroplating the noble potential nickel plating layer 5*a*, and also, by its own film property of the trivalent chrome plating.

The substrate 2 is not necessarily limited to a resin material represented by ABS resin (acrylonitrile-butadiene-styrene resin). Both resin and metal are available for the substrate 2 as long as decorative chrome plating is possible. In the case of a resin material, electroplating is possible by providing electrical conductivity to the surface of the material by means of electroless plating, a direct process and the like.

Also, in the all plating layer 3, the copper plating layer 4 is not necessarily limited to copper. The copper layer 4 is generally formed on the substrate 2 for the purpose of the increase in smoothness, and also, for the purpose of the reduction of the linear expansion coefficient difference between the substrate 2 and the nickel plating layer 5. While, instead of the copper plating layer, the nickel plating and the tin-copper alloy plating, for Example, are available, which can achieve similar effects.

In addition, a tri-nickel plating layer may be provided between the bright nickel plating layer 5*b* and non-sulfur nickel plating layer 5*c* for the purpose of preventing progress of the corrosion to the non-sulfur nickel plating layer 5*c*. The tri-nickel plating layer contains the higher sulfur content and is easier to be corroded than the bright nickel plating layer 5*b*. Therefore, the lateral corrosion of the tri-nickel plating layer with the bright nickel plating layer 5*b* is enhanced so as to prevent further progress of the corrosion to the non-sulfur nickel plating layer 5*c*.

The noble potential nickel plating layer 5*a* for the purpose of dispersing the corrosion current of the chrome-plated part 1 is preferably capable of providing at least one of the microporous structure and the microcrack structure to the trivalent chrome plating layer 6. Due to the noble potential nickel plating layer 5*a* being such a plating, it is possible to increase density of the fine pores by a synergistic effect between the microporous structure that the trivalent chrome plating layer 6 (trivalent chrome plating film 6*a*) itself potentially has. Thus, it enables the microporous corrosion to the nickel plating layer 5 to be more finely-dispersed.

In order to make the noble potential nickel plating layer 5*a* capable of providing the microporous structure to the trivalent chrome plating layer 6, the compound containing at least one of silicon (Si) and aluminum (Al) is dispersed into the noble potential nickel plating layer 5*a*. For such a compound, fine particles of aluminum oxide (alumina) and silicon dioxide (silica) can be used. Preferably, the fine particles made by covering on surfaces of powder made of silicon dioxide with aluminum oxide are used. In the noble potential nickel plating layer 5*a* electroplated in the plating bath in which the fine particles are dispersed, the fine particles are finely and uniformly mixed. As a result, it is possible to efficiently form the microporous structure in the trivalent chrome plating layer 6 that is to be formed thereafter. The trivalent chrome plating layer 6 itself has the microporous structure and microcrack structure with quite fine and numerous pores. Therefore, it is possible to achieve the purpose of the present embodiment without the fine particles in the noble potential nickel plating layer 5*a*. However, by the use of the fine particles, it is possible to form much more fine pores.

Mode for the Invention

The present invention will be illustrated further in detail by the following Examples and Comparative Examples, however, the scope of the invention is not limited to these Examples.

(Preparation of Test Pieces)

Test pieces as samples of the chrome-plated part of the present invention were prepared as Examples 1 to 9, and test pieces for comparison with Examples 1 to 9 were prepared as Comparative Examples 1 to 7. The test pieces of Examples 1 to 9 and Comparative Examples 1 to 7 were individually prepared by the following way.

The substrate of each test piece of Examples 1 to 9 and Comparative Examples 1 to 7 was ABS resin roughly having a size of a business card. Every test piece was subjected to the plating treatments in order of copper plating and non-sulfur nickel plating after the pretreatment. The copper plating and non-sulfur nickel plating were performed by using the commercially-produced plating bath. Then, each of bright nickel plating, noble potential nickel plating and chrome plating was sequentially performed under different conditions, respectively. In Comparative Examples 1 and 2, the chrome plating layer was formed directly after forming the bright nickel plating layer without the noble potential nickel plating layer.

(Bright Nickel Plating)

The plating bath to form the bright nickel plating layer was mainly composed of a watts bath containing 280 g/l of nickel sulfate hexahydrate ($NiSO_4$-$6H_2O$), 50 g/l of nickel dichloride hexahydrate ($NiCl_2$-$6H_2O$) and 35 g/l of boric acid ($H_3BO_3$). In addition, 1.5 g/l of saccharin as a first brightening agent and 0.2 g/l of 1,4-butynediol as a second brightening agent were added to the plating bath. With regard to the electrolysis condition of the bright nickel plating, the temperature of the plating bath was set at 55 degrees C., current density was set at 3 A/dm$^2$, and a nickel electrode was used as an anode.

(Noble Potential Nickel Plating)

The plating bath to form the noble potential nickel plating layer was mainly composed of a watts bath containing 280 g/l of nickel sulfate hexahydrate ($NiSO_4$-$6H_2O$), 50 g/l of nickel dichloride hexahydrate ($NiCl_2$-$6H_2O$) and 35 g/l of boric acid ($H_3BO_3$). In addition, 1.5 g/l of saccharin as a first brightening agent, 1,4-butynediol as a second brightening agent and chloral hydrate as an electric potential adjuster were added to the plating bath. Note that, the additive amount of the electric potential adjuster was adjusted to be the potential differences shown in Table 1. In Examples 1 to 4, 6 to 9 and Comparative Examples 3 to 7, fine particles were added so as to increase fine pores of the trivalent chrome plating layer. With regard to the electrolysis condition of the noble potential nickel plating, the temperature of the plating bath was set at 50 degrees C., current density was set at 11 A/dm$^2$, and a nickel electrode was used as an anode.

(Chrome Plating)

In Examples 1 to 9 and Comparative Examples 1 to 4, the trivalent chrome plating layer was formed by use of TriChrome Plus process made of Atotech Deutschland GmbH. In Comparative Examples 5 and 6, the hexavalent chrome plating layer was formed by use of the plating bath containing 250 g/l of chromium trioxide ($CrO_3$), 1 g/l of sulfuric acid, and 7 g/l of sodium silicofluoride ($Na_2SiF_6$). In Comparative Example 7, the trivalent chrome plating layer was formed by use of Envirochrome process made of Canning Japan K.K. However, iron was not included in the plating layer. With regard to the electrolysis condition of the chrome plating, the temperature of the plating bath was set at 35 degrees C., current density was set at 10 A/dm$^2$, and an appropriate electrode to each process was selected for use in an anode. With respect to Comparative Example 7, an acidic electrolytic chromate treatment was performed after the trivalent chrome plating layer was formed. In Examples 1 to 9 and Comparative Examples 1 to 6 except Comparative Example 7, however, no aftertreatment was performed except for water rinsing.

Examples 1 to 9 are the chrome-plated parts according to the present invention. While, the chrome plating layers of Comparative Examples 1 and 2 are provided by trivalent chromium but not included the noble potential nickel plating layers. Moreover, the chrome plating layers of Comparative Examples 3 and 4 are provided by trivalent chromium but the potential difference is below 40 mV. The chrome plating layer of Comparative Example 5 is provided by hexavalent chromium, and the potential difference is below 40 mV. While the chrome plating layer of Comparative Example 6 is provided by hexavalent chromium, the potential difference is 40 mV or more. The chrome plating layer of Comparative Example 7 is provided by trivalent chromium, but the potential difference is below 40 mV, and the element concentrations of carbon and oxygen in the chrome plating layer are low.

Figure 2:
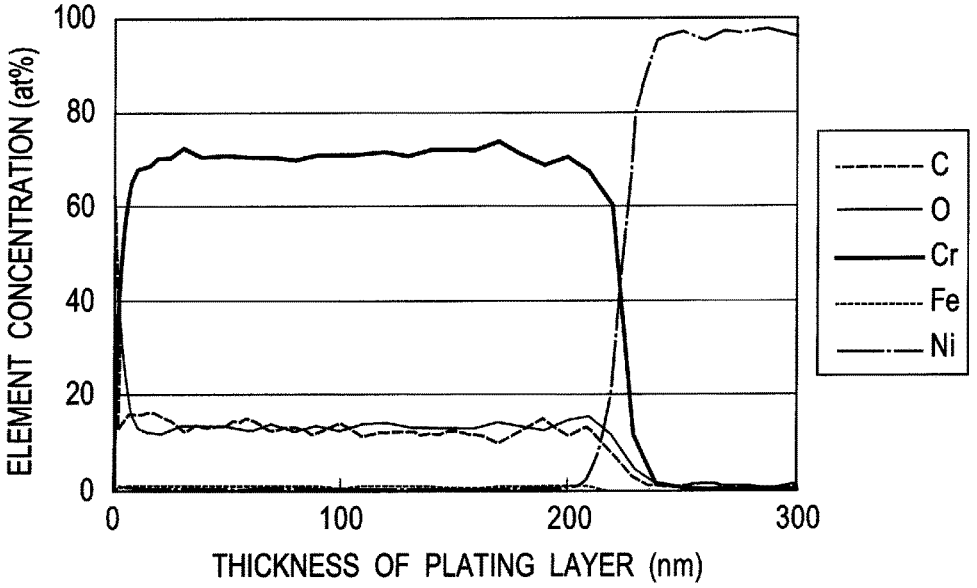
FIG. 2 is an XPS data of a test piece of Example 1.

Table 1 shows the thickness and the element concentration of the chrome plating layer, the potential difference between the bright nickel plating layer and noble potential nickel plating layer, the microporous density of the chrome plating layer, the chemical species of fine particles added in the plating bath to form the noble potential nickel plating layer, and the results of the corrosion tests described later. The thickness of the chrome plating layer was obtained by a galvanostatic electrolysis method. According to an X-ray photoemission spectroscopy spectrum analysis as shown in FIG. 2, an area that a spectrum of chromium was substantially flat was considered as the element concentration of the chrome plating layer, then the range value was observed. The potential difference between the bright nickel plating layer and noble potential nickel plating layer was measured by use of an electrometer.

The microporous density was measured by the following way. First, a solution containing 33 g/l of copper sulfate pentahydrate, 16 g/l of sulfuric acid, and 2.2 g/l of potassium chloride was prepared. Next, each test piece of Examples and Comparative Examples was impregnated with the solution, a surface reactivation was performed at 0.8 V for 30 seconds on the anode side, and a copper electrodeposit was performed at 0.4 V for 30 seconds on the cathode side. Then, each test piece was dried, the surfaces of the test pieces were observed by an optical microscope, only 2 micrometers or more of the copper electrodeposit points were extracted by means of an image analysis, and the precipitation density of the copper electrodeposit points per 1 $cm^2$ was calculated.

In addition, in Table 1, chemical species of fine particles in the noble potential nickel plating layer were indicated as follows. The test piece that the microporous structure and the microcrack structure were provided only because of the characteristics of the trivalent chrome plating, in other words, the test piece that was produced by the step in which the component providing the microporous structure and the microcrack structure were not included was indicated by "no component". Also, the test pieces that were produced by the plating bath, to which the fine particles containing silicon dioxide as a main component were added, were indicated by "Si". Further, the test pieces that were produced by the plating bath, to which the fine particles containing aluminum oxide as a main component in order for improvement of fine particle dispersibility in addition to aforementioned silicon dioxide were added, were indicated by "Al—Si".

The test pieces of Examples and Comparative Examples, which were produced under the above-mentioned condition, provided a white silver design equivalent to the hexavalent chrome plating. Moreover, these test pieces were uniformly plated, and determined to be nothing wrong with the appearance in the corrosion tests.

(Corrosion Test for Test Pieces)

Each test piece of Examples 1 to 9 and Comparative Examples 1 to 7 was subjected to the corrosion tests 1 and 2.

The corrosion test 1 was carried out according to a loading manner described in "Japan industrial standards JIS H 8502 CASS test". The test times were for 40 and 80 hours.

The corrosion test 2 was carried out as a corrodkote corrosion test. Specifically, a muddy corrosion accelerator including a mixture of 30 g of kaolin and 50 ml of calcium chloride saturated aqueous solution were prepared. Then, a certain amount of the accelerator was uniformly applied to the surface of each test piece, and the test pieces were left in a constant temperature and humidity chamber maintained at 60 degrees C. and 23% RH (relative humidity) environment. The test time included 6 steps of 4, 24, 168, 336, 504, and 600 hours.

The aforementioned corrosion test 1 was employed in order to determine the resistance to microporous corrosion and plating blister in the case of applying the chrome-plated part according to the present invention to an automobile exterior part. Also, the corrosion test 2 was employed to determine the resistance to chromium dissolution corrosion of the chrome-plated part according to the present invention.

The evaluation after the aforementioned corrosion test 1 employed an evaluation method similar to a rating number based on the entire corrosion area ratio according to JIS H 8502. The difference from JIS H 8502 is a way of handling fine corrosion spots. In JIS H 8502, the evaluation is performed for corrosion spots except corrosion spots with a size of not more than 0.1 mm (100 micrometers). However, in the light of the increase in users' performance requirements for automobile exterior parts in recent years, the size of the corrosion spots not evaluated was set to not more than 30 micrometers in the evaluation of the corrosion test 1. Accordingly, corrosion spots with a size of 30 to 100 micrometers, which were not evaluated in the JIS H 8502, were included in the evaluation, so that the evaluation for the corrosion test 1 of Table 1 was stricter than that based on the JIS H8502. The maximum rating of the corrosion test 1 was 10.0, and a larger number of the rating denotes a smaller corrosion area and higher corrosion resistance. The results shown in Table 1 were evaluated by the aforementioned test and evaluation methods using six grades: AAA—test pieces having a rating number of 9.8 or more; AA—test pieces having a rating number of 9.0 or more and less than 9.8; A—test pieces having a rating number of 8.0 or more and less than 9.0; B—test pieces having a rating number of 6.0 or more and less than 8.0; C—test pieces having a rating number of 4.0 or more and less than 6.0; and D—test pieces having a rating number of less than 4.0, or being caused blisters.

At the evaluation after the aforementioned corrosion test 2 was executed, first, the applied mud was removed by flowing water or the like so as not to damage the surface of the test piece, and the test piece was dried. Then, the time to when occurrence of visually identifiable white tarnish or interference color (the starting point of occurrence of chrome dissolving corrosion) were identified was measured. It is meant that the test piece of which measured time is longer has a higher resistance to chrome dissolving corrosion. The results shown in Table 1 were evaluated by the aforementioned test and evaluation methods using four grades: C—test pieces of which changes in appearance such as white tarnish, inference color, and dissolution of the chrome plating layers were observed within 4 hours; B—test pieces in which the above changes in appearance were observed in 336 hours; A—test pieces in which the above changes in appearance were observed in 600 hours; and AA—test pieces in which no changes in appearance were observed after 600 hours.

TABLE 1

| | Thickness of chrome plating layer | Element concentration of chrome plating layer (at %) | | | | Potential | Micro-porous density | Chemical species of fine | Corrosion test 1 (CASS) | | Corrosion test 2 (Calcium |
|---|---|---|---|---|---|---|---|---|---|---|---|
| | (μm) | Chromium | Oxygen | Carbon | Iron | difference | (×1000/cm) | particles | 40H | 80H | chloride mud) |
| Ex. 1 | 0.22 | 67-74 | 12-16 | 10-16 | 0.5-1.0 | 78 | 200-250 | Al—Si | AAA | AAA | AA |
| Ex. 2 | 0.2 | 68-73 | 9.0-14 | 11-14 | 3.0-5.0 | 85 | 180-200 | Al—Si | AAA | AA | AA |

TABLE 1-continued

| | Thickness of chrome plating layer | Element concentration of chrome plating layer (at %) | | | | Potential | Micro-porous density | Chemical species of fine | Corrosion test 1 (CASS) | | Corrosion test 2 (Calcium |
|---|---|---|---|---|---|---|---|---|---|---|---|
| | (μm) | Chromium | Oxygen | Carbon | Iron | difference | (×1000/cm) | particles | 40H | 80H | chloride mud) |
| Ex. 3 | 0.19 | 68-78 | 9.5-13 | 11-13 | 2.0-3.4 | 115 | 72-76 | Al—Si | AAA | AAA | AA |
| Ex. 4 | 0.32 | 72-80 | 11-16 | 4.0-10 | 1.0-2.4 | 65 | 27-37 | Si | A | B | AA |
| Ex. 5 | 0.26 | 70-74 | 9.0-11 | 7.0-10 | 0.5-1.2 | 70 | 10-17 | No component | A | B | AA |
| Ex. 6 | 0.3 | 67-76 | 9.7-12 | 8.0-10 | 1.0-2.0 | 53 | 25-38 | Al—Si | AA | A | A |
| Ex. 7 | 0.24 | 69-79 | 10-15 | 8.6-11 | 1.3-2.5 | 43 | 29-34 | Al—Si | AA | AA | AA |
| Ex. 8 | 0.33 | 70-82 | 7-8 | 7-15 | 3-8 | 62 | Ultrafine cracks | Al—Si | AAA | AAA | AA |
| Ex. 9 | 0.48 | 71-74 | 9-10 | 6-9 | 9-11 | 146 | Ultrafine cracks | Si | AAA | A | A |
| Com. Ex. 1 | 0.16 | 70-75 | 15-20 | 3.8-8.1 | 2.4-4.1 | — | 16-19 | — | C | D | A |
| Com. Ex. 2 | 0.22 | 69-82 | 10-17 | 4.3-9.3 | 0.9-3.0 | — | 0.7-1.9 | — | B | D | A |
| Com. Ex. 3 | 0.23 | 70-75 | 9.0-12 | 6.0-10 | 1.0-3.2 | 32 | 1.4-2.4 | Si | C | D | B |
| Com. Ex. 4 | 0.3 | 67-75 | 9.3-11 | 8.4-10 | 0.8-1.5 | 36 | 24-54 | Al—Si | B | C | A |
| Com. Ex. 5 | 0.21 | 97-99 | 1-3 | 0 | 0 | 35 | 10-12 | Si | AA | A | C |
| Com. Ex. 6 | 0.16 | 97-99 | 1-3 | 0 | 0 | 75 | 13-16 | Si | D | D | C |
| Com. Ex. 7 | 0.36 | 81-86 | 4-7 | 1-3 | 0 | 17 | 20-27 | Si | AA | A | C |

According to Table 1, the evaluation results of the aforementioned corrosion tests 1 and 2 in Examples 1 to 9 were B or more. Especially with regard to Examples 1 to 3, 7 and 8, almost no changes in appearance were observed in the corrosion test 1 for 80 hours. Further, according to Examples 1 to 3 in Table 1, the high corrosion resistance was shown in both the corrosion tests 1 and 2 in the case of forming more than 50000/cm$^2$ of microporous on the surface of the trivalent chrome plating layer.

FIG. 2 shows the XPS data of the test pieces of Example 1. In FIG. 2, the point of 220 nm (0.22 micrometers) where the concentration of chromium rapidly degreases indicates the borderline of the presence of the trivalent chrome plating layer 6. The deeper area than the borderline of 220 nm is the nickel plating layer 5. Table 1 and FIG. 2 show that the chrome plating film 6*a* contains 0.5 to 1.0 at % of iron and 10 to 16 at % of carbon. Therefore, it is considered that the passive film 6*b* formed on the surface of the chrome plating layer 6 is densified, which means the improvement of the corrosion resistance.

Figure 3:
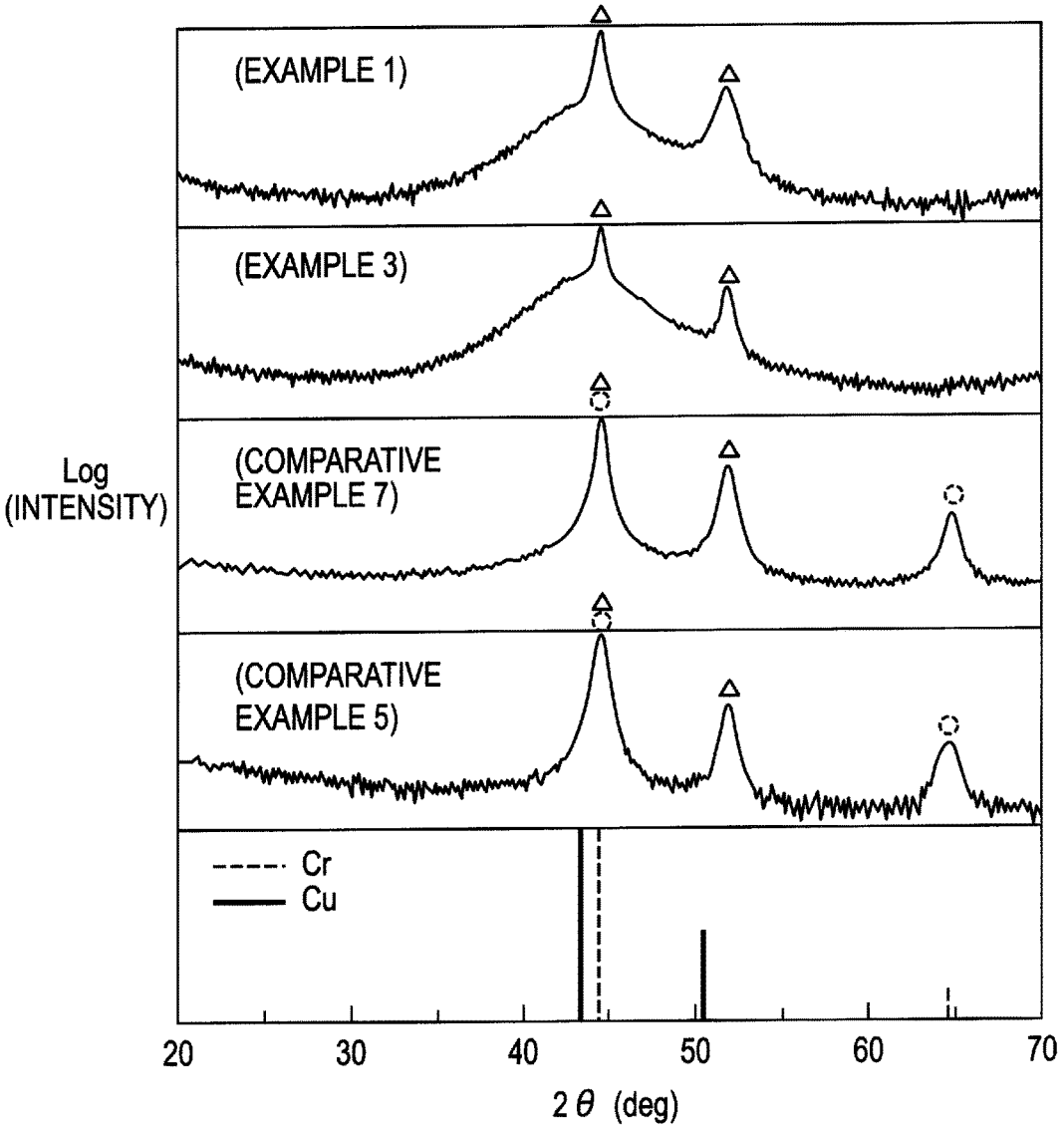
FIG. 3 is an XRD data of Examples 1 and 3 and Comparative Examples 7 and 5.

FIG. 3 shows the XRD data of Examples 1 and 3 and Comparative Examples 7 and 5. As shown in FIG. 3, the chromium-derived crystalline peaks were not recognized around 2theta=65 degrees in Examples 1 and 3. This indicates that the chrome plating layers of Examples 1 and 3 are amorphous. Thus, it is considered that the corrosion resistance was improved in Examples 1 and 3 since the plating defect that may cause the starting point of occurrence of the corrosion was extremely decreased because of being amorphous.

Figure 4:
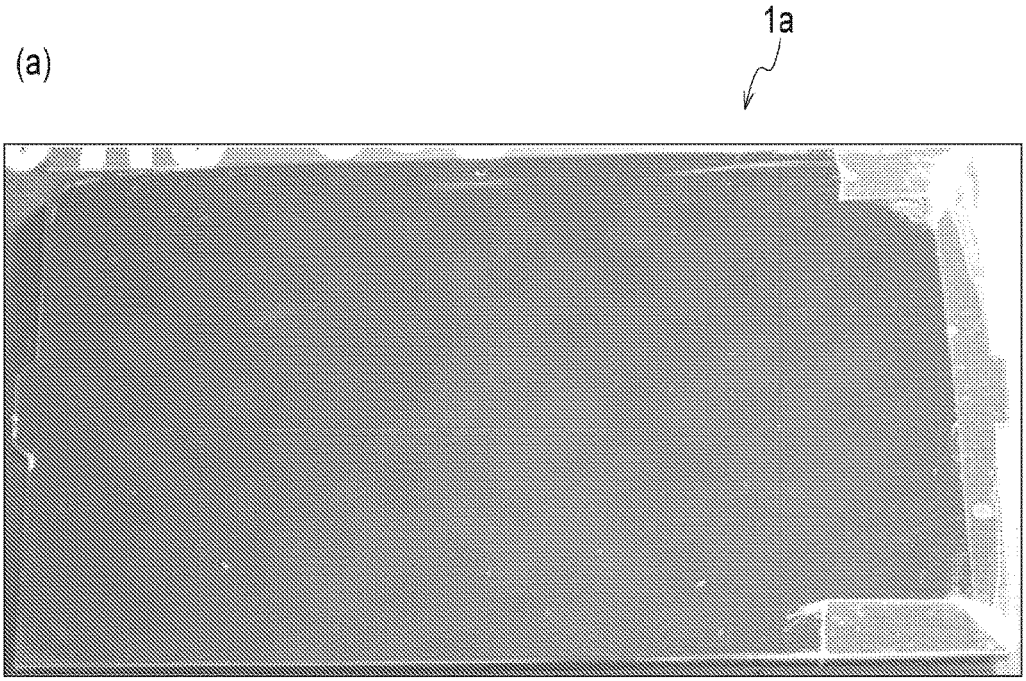
FIG. 4(*a*) is a picture showing a test piece of Example 1 after a corrosion test 1 for 80 hours.
Figure 4:
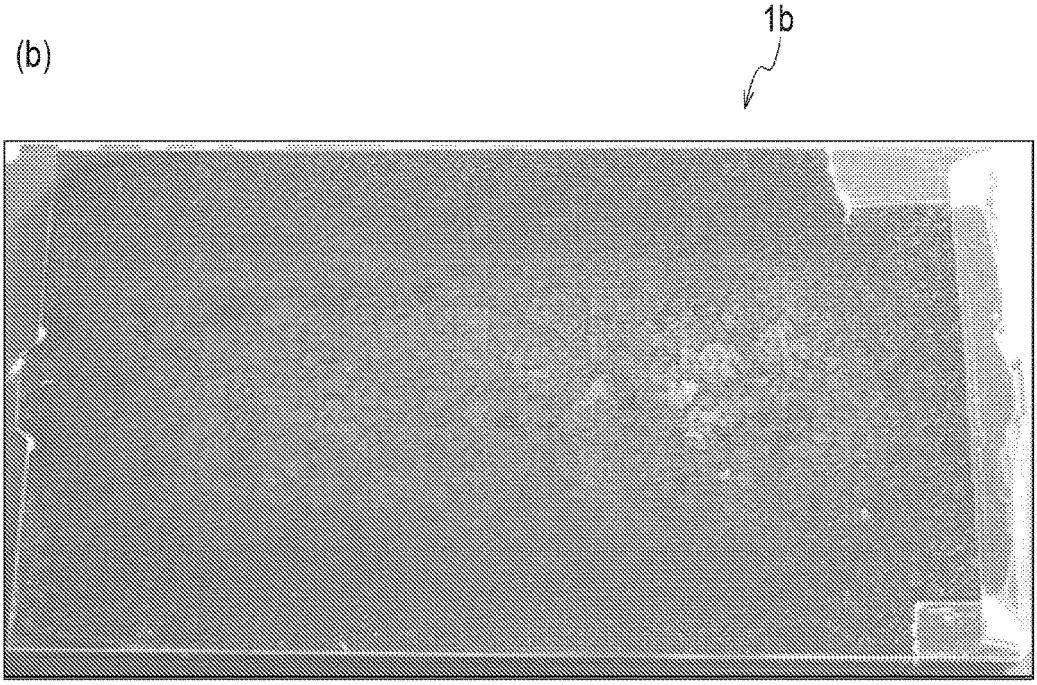

FIG. 4(*a*) is a picture of the test piece of Example 1 after the corrosion test 1 for 80 hours. Thus, blisters and corrosion of the chrome plating layer in the chrome-plated part 1*a* of Example 1 were not caused even after the CASS test, also almost no changes in appearance were observed compared to before the test. In addition, FIG. 4(*b*) is a picture of the test piece of Example 4 after the corrosion test 1 for 80 hours. Compared to Example 1, corrosion is slightly observed in the chrome-plated part 1*b* of Example 4, however, the level of the corrosion is considerably lowered compared to the after-mentioned Comparative Examples.

Figure 5:
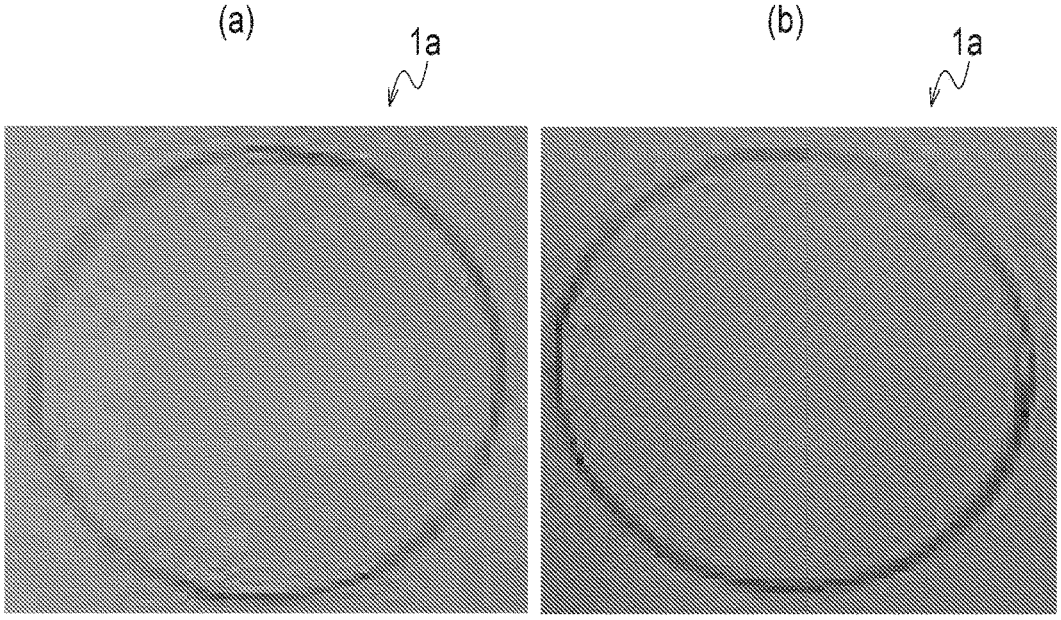
FIG. 5(*a*) is a picture showing a test piece of Example 1 after a corrosion test 2.

FIG. 5(*a*) is a picture of the test piece of Example 1 after the corrosion test 2, and FIG. 5(*b*) is a picture of the test piece of Example 1 before the corrosion test 2. According to the comparison of FIG. 5(*a*) with 5(*b*), almost no changes of the test pieces in appearance were observed in the chrome-plated part 1*a* of Example 1 before and after the corrosion test 2.

Whereas, as seen Table 1, the evaluations of C and D in the evaluation results of the corrosion tests 1 and 2 are seen in places in Comparative Examples 1 to 7. Especially, in Comparative Example 5 related to the conventional art, a certain effect was seen in the CASS test. However, severe corrosion of the chrome plating layer was observed in the calcium chloride resistance test.

Further as shown in FIG. 3, the chromium-derived crystalline peaks were recognized in Comparative Examples 5 and 7. Thus, it is considered that the resistance to calcium chloride is lowered when the chrome plating layer is crystallized.

Figure 6:
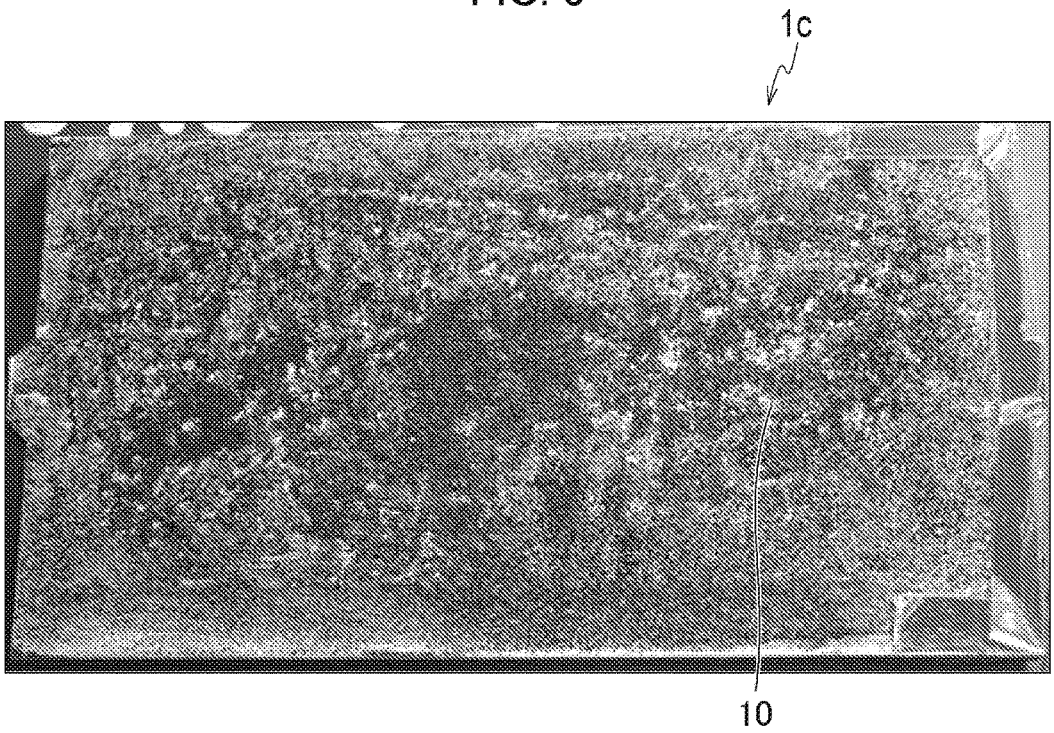
FIG. 6 is a picture showing a test piece of Comparative Example 1 after the corrosion test 1 for 40 hours.

FIG. 6 is a picture of the test piece of Comparative Example 1 after the corrosion test 1 for 40 hours. In the chrome-plated part 1*c* of Comparative Example 1, severe corrosion spots 10 were observed compared to Examples 1 and 4 in FIG. 4. Thus, locally-concentrated corrosion in the bright nickel plating layer is caused unless the noble potential nickel plating layer is formed, and the potential difference between the bright nickel plating layer and the noble potential nickel plating layer is set at 40 mV or more.

Figure 7:
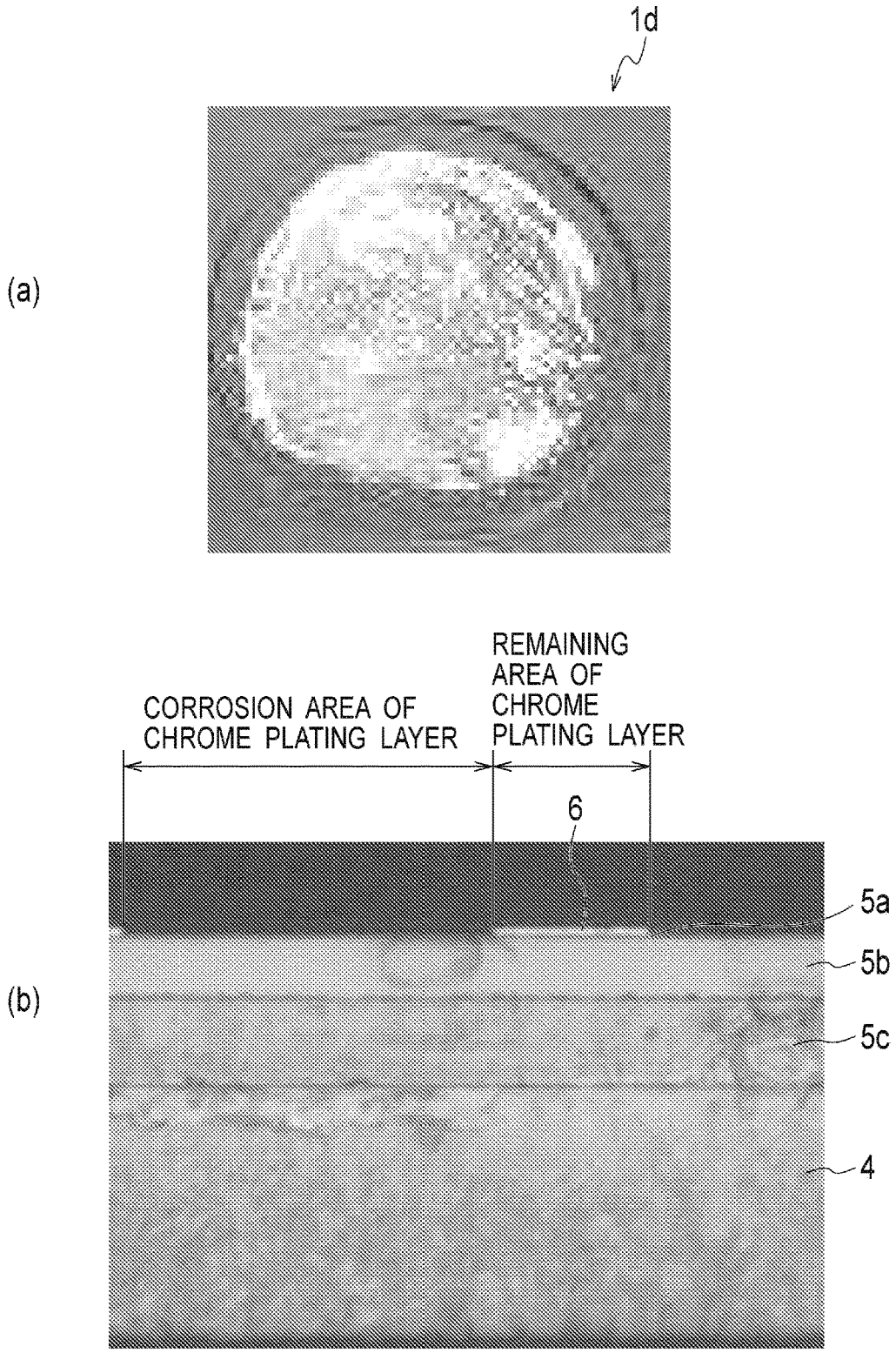
FIG. 7(*a*) is a picture showing a test piece of Comparative Example 5 after the corrosion test 2.

FIG. 7(*a*) is a picture of the test piece of Comparative Example 5 after the corrosion test 2, and FIG. 7(*b*) is a cross-sectional view of the test piece of FIG. 7(*a*). The appearance of chrome-plated part of Comparative Example 5 before the corrosion test 2 was similar to FIG. 5(*b*). As shown in FIG. 7, however, most of the chrome plating layer 6 of the surface layer in the chrome plating part 1*d* of Comparative Example 5 after the corrosion test 2 were corroded. Thus, it can be recognized that the resistance to calcium chloride is distinctly lowered if the chrome plating layer is produced by hexavalent chromium.

Moreover, in Comparative Example 6 that the potential difference is 40 mV or more using the hexavalent chrome plating layer, severe blisters were caused as the conventional art pointed out.

Thus, it can be understood that the chrome-plated part of Example according to the present invention has the advantage of being able to apply for automobile exterior parts while having the corrosion resistance in various environmental conditions; however, the chrome-plated part of Comparative Example is inferior in corrosion resistance.

The entire content of a Japanese Patent Application No. P2009-030706 with a filing date of Feb. 13, 2009 is herein incorporated by reference.

Although the invention has been described above by reference to certain embodiments of the invention, the invention is not limited to the embodiments described above and modifications may become apparent to these skilled in the art, in light of the teachings herein. The scope of the invention is defined with reference to the following claims.

Industrial Applicability

A chrome plating part according to the present invention has an electric potential difference between a bright nickel plating layer and a noble potential nickel plating layer which is within a range from 40 mV to 150 mV, and has a chrome plating layer which is provided by trivalent chromium. Thus, the chrome-plated part of the present invention has high resistance to the corrosion and blisters caused by various types of damage by salt attack, while providing a white silver design equivalent to a hexavalent chrome plating.

According to a method of manufacturing a chrome-plated part of the present invention, it is possible to lower cost of manufacturing because additional treatments are not required after forming a chrome plating layer. Furthermore, the chrome plating layer of the chrome-plated part of the present invention is formed not using a hexavalent chrome plating bath which has high toxicity, but using a trivalent chrome plating bath so as to reduce the influence to the environment.

The invention claimed is:

1. A chrome-plated part, comprising:

a substrate;

a bright nickel plating layer formed over the substrate;

a noble potential nickel plating layer formed on the bright nickel plating layer, wherein an electric potential difference between the bright nickel plating layer and the noble potential nickel plating layer is within a range from 78 mV to 150 mV, and the electric potential of the bright nickel plating layer is a base potential with respect to the noble potential nickel plating layer; and a trivalent chrome plating layer formed on the noble potential nickel plating layer, containing 0.5 at % or more of iron, and having at least any one of a microporous structure or a microcrack structure, wherein the trivalent chrome plating layer has a microporous density of 180,000/cm$^2$ or more, wherein the bright nickel plating layer is manufactured with a first brightening agent and a second brightening agent, wherein the first brightening agent comprises 1,5-sodium naphthalene disulfonate, 1,3,6-sodium naphthalene trisulfonate, saccharin, or paratoluene sulfonamide, and wherein the second brightening agent comprises formaldehyde, 1,4-butynediol, propargyl alcohol, ethylene cyanohydrin, coumarin, thiourea, or sodium allylsulfonate.

2. The chrome-plated part according to claim 1, wherein the trivalent chrome plating layer contains carbon and oxygen.

3. The chrome-plated part according to claim 1, wherein the trivalent chrome plating layer is produced by basic chromium sulfate as a metal source, and the trivalent chrome plating layer further contains iron.

4. The chrome-plated part according to claim 1, wherein the trivalent chrome plating layer contains 4.0 at % or more of carbon.

5. The chrome-plated part according to claim 1, wherein the trivalent chrome plating layer contains at least one of 1 at % to 20 at % of iron and 10 at % to 20 at % of carbon.

6. The chrome-plated part according to claim 1, wherein the trivalent chrome plating layer is amorphous.

7. The chrome-plated part according to claim 1, wherein the bright nickel plating layer contains sulfur.

8. The chrome-plated part according to claim 1, wherein a thickness of the trivalent chrome plating layer is between 0.15 μm to 0.5 μm.

9. A method of manufacturing a chrome-plated part, comprising:

forming a bright nickel plating layer over a substrate;

forming a noble potential nickel plating layer on the bright nickel plating layer, wherein an electric potential difference between the bright nickel plating layer and the noble potential nickel plating layer is within a range from 78 mV to 150 mV, and the electric potential of the bright nickel plating layer is a base potential with respect to the noble potential nickel plating layer; and forming a trivalent chrome plating layer on the noble potential nickel plating layer, the trivalent chrome plating layer containing 0.5 at % or more of iron, and having at least any one of a microporous structure or a microcrack structure, wherein the trivalent chrome plating layer has a microporous density of 180,000/cm$^2$ or more, wherein forming the bright nickel plating layer comprises using a first brightening agent and a second brightening agent, wherein the first brightening agent comprises 1,5-sodium naphthalene disulfonate, 1,3,6-sodium naphthalene trisulfonate, saccharin, or paratoluene sulfonamide, and wherein the second brightening agent comprises formaldehyde, 1,4-butynediol, propargyl alcohol, ethylene cyanohydrin, coumarin, thiourea, or sodium allylsulfonate.

10. The method of manufacturing a chrome-plated part according to claim 9, wherein an amount of an electric potential adjuster added in a first plating bath to form the noble potential nickel plating layer is adjusted to be more than that added in a second plating bath to form the bright nickel plating layer.

11. The method of manufacturing a chrome-plated part according to claim 9, wherein the noble potential nickel plating layer is formed via a first plating bath into which a compound comprising at least any one of silicon and aluminum is dispersed.

12. The method of manufacturing a chrome-plated part according to claim 9, wherein the noble potential nickel plating layer is formed via a first plating bath into which aluminum oxide is dispersed.

13. The method of manufacturing a chrome-plated part according to claim 9, wherein the electric potential difference between the bright nickel plating layer and the noble potential nickel plating layer is within a range from 78 mV to 120 mV.

14. A chrome-plated part, comprising:

a substrate;

a bright nickel plating layer formed over the substrate;

a noble potential nickel plating layer formed on the bright nickel plating layer, wherein an electric potential difference between the bright nickel plating layer and the noble potential nickel plating layer is within a range from 78 mV to 150 mV, and the electric potential of the bright nickel plating layer is a base potential with respect to the noble potential nickel plating layer; and a trivalent chrome plating layer formed on the noble potential nickel plating layer, containing 0.5 at % or more of iron, and having at least any one of a microporous structure or a microcrack structure, wherein the trivalent chrome plating layer has a microporous density of 180,000/$cm^2$ or more, wherein the bright nickel plating layer comprises a first brightening agent and a second brightening agent, wherein the first brightening agent comprises 1,5-sodium naphthalene disulfonate, 1,3,6-sodium naphthalene trisulfonate, saccharin, or paratoluene sulfonamide, and wherein the second brightening agent comprises formaldehyde, 1,4-butynediol, propargyl alcohol, ethylene cyanohydrin, coumarin, thiourea, or sodium allylsulfonate.

15. The chrome-plated part according to claim 14, wherein the trivalent chrome plating layer contains carbon and oxygen.

16. The chrome-plated part according to claim 14, wherein the trivalent chrome plating layer is produced by basic chromium sulfate as a metal source, and the trivalent chrome plating layer further contains iron.

17. The chrome-plated part according to claim 14, wherein the trivalent chrome plating layer contains 4.0 at % or more of carbon.

18. The chrome-plated part according to claim 14, wherein the trivalent chrome plating layer contains at least one of 1 at % to 20 at % of iron and 10 at % to 20 at % of carbon.

19. The chrome-plated part according to claim 14, wherein the trivalent chrome plating layer is amorphous.

20. The chrome-plated part according to claim 14, wherein the bright nickel plating layer contains sulfur.

21. The chrome-plated part according to claim 14, wherein a thickness of the trivalent chrome plating layer is between 0.15 μm to 0.5 μm.

* * * * *